US009084443B2

(12) United States Patent
Moulden et al.

(10) Patent No.: US 9,084,443 B2
(45) Date of Patent: Jul. 21, 2015

(54) ARTICLE OF APPAREL WITH INTEGRATED SUPPORT STRUCTURE

(71) Applicant: Under Armour, Inc., Baltimore, MD (US)

(72) Inventors: Shannon Moulden, Baltimore, MD (US); Jami Dunbar, Hanover, MD (US); Angela Farina, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 14/048,381

(22) Filed: Oct. 8, 2013

(65) Prior Publication Data

US 2014/0099864 A1 Apr. 10, 2014

Related U.S. Application Data

(60) Provisional application No. 61/711,006, filed on Oct. 8, 2012.

(51) Int. Cl.
*A41C 3/00* (2006.01)
*A41C 3/08* (2006.01)

(52) U.S. Cl.
CPC ..... *A41C 3/08* (2013.01)

(58) Field of Classification Search
CPC ..... A41C 1/00; A41C 1/06; A41C 3/00; A41C 3/0014; A41C 3/0021; A41C 3/0035; A41C 3/0005; A41C 3/0085; A41C 3/10; A41C 3/14; A41C 3/12; A41C 3/44; A41C 3/46; A41C 3/48; A41C 5/00
USPC ..... 450/19–21, 34, 54–57, 39, 44, 92, 53, 450/60, 65, 66, 74–76
See application file for complete search history.

(56) References Cited

U.S. PATENT DOCUMENTS

| | | | | |
|---|---|---|---|---|
| 6,287,168 | B1 * | 9/2001 | Rabinowicz | 450/75 |
| 6,443,805 | B1 * | 9/2002 | Kirkwood | 450/31 |
| 6,530,820 | B1 * | 3/2003 | Katze et al. | 450/7 |
| 6,790,122 | B2 * | 9/2004 | Mitchell et al. | 450/66 |
| 6,811,462 | B1 * | 11/2004 | Kenneally | 450/30 |
| 7,169,011 | B2 * | 1/2007 | Mitchell et al. | 450/66 |
| 2003/0171066 | A1 * | 9/2003 | Mitchell et al. | 450/66 |

* cited by examiner

*Primary Examiner* — Gloria Hale

(57) ABSTRACT

An article of apparel includes an integrated support system. In an embodiment, the article of apparel is a tank top including a body and shoulder straps. The support structure, moreover, is a bra suspended from the interior of the body. The bra includes textile segments possessing predetermined degrees of resiliency. In an embodiment, the bra includes first and second cups, each including a pocket operable to receive an insert. The cups may be laterally spaced from each other by a non-stretch textile. The rear of the bra may be formed of a resilient textile.

12 Claims, 4 Drawing Sheets

ARTICLE OF APPAREL WITH INTEGRATED SUPPORT STRUCTURE

CROSS REFERENCE TO RELATED APPLICATIONS

The present invention claims priority to provisional application No. 61/711,006, entitled "Shirt with Inner Support" and filed 8 Oct. 2012, the disclosure of which is hereby incorporated by reference in its entirety.

FIELD OF THE INVENTION

The present invention relates to an article of apparel including an integral support and, in particular, to shirt including an integrated bra.

BACKGROUND OF THE INVENTION

Some articles of apparel do not work well with a separate undergarment, e.g., a brassiere. For example, when a regular brassiere is worn under a strapless gown or a shirt with shoulder straps, the shoulder straps of the brassiere are often exposed, creating an unsightly condition where the brassiere shoulder straps are visible. While attempts have been made to integrate a brassiere into a garment, these lack proper support or comfort necessary for effective use. Accordingly, it would desirable to provide an article of apparel with an integrated support structure that is comfortable and provides adequate support during use.

BRIEF SUMMARY OF THE INVENTION

The present invention is directed toward an article of apparel including an integrated support system. In an embodiment, the article of apparel is a tank top including a body and shoulder straps. The support structure, moreover, is a bra suspended from the interior of the body. The bra includes textile segments possessing predetermined degrees of resiliency. In an embodiment, the bra includes first and second cups, each including a pocket operable to receive an insert. The cups may be laterally spaced from each other by a non-stretch textile. The rear of the bra may be formed of a resilient textile.

DETAILED DESCRIPTION OF THE INVENTION

Figure 1B:
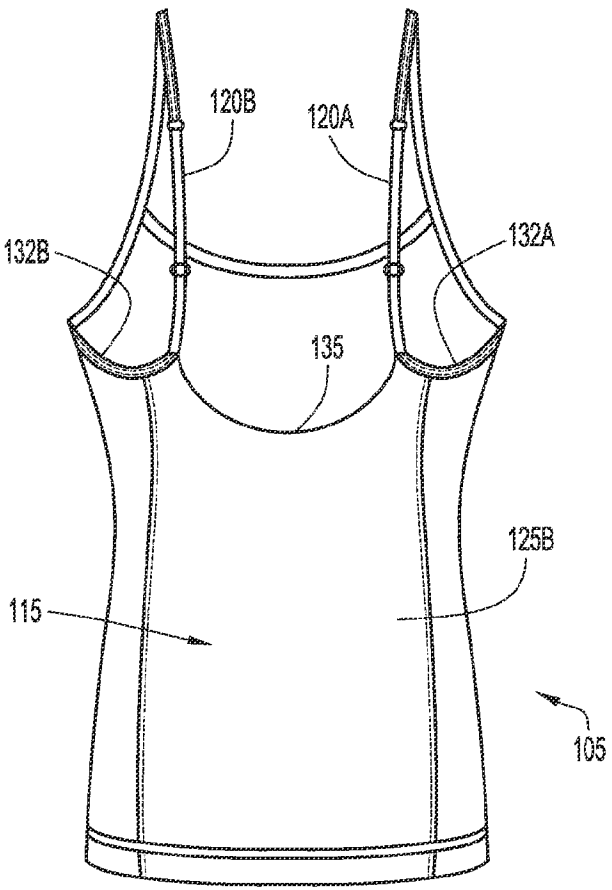
FIG. 1B is a rear view of an article of apparel of in accordance with an embodiment of the invention.
Figure 1A:
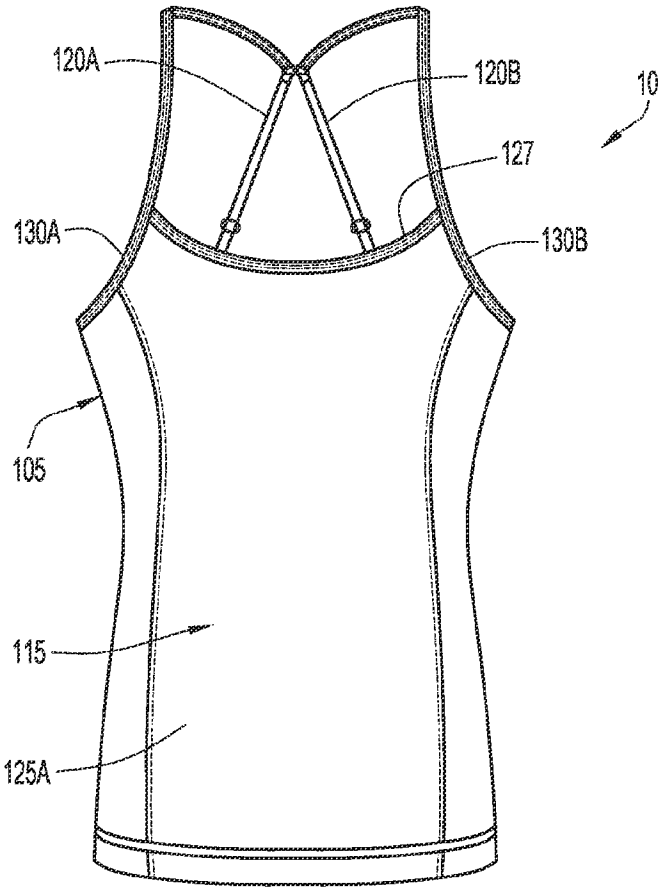
FIG. 1A is a front view of an article of apparel in accordance with an embodiment of the invention.

An article in accordance with the present invention is illustrated in FIGS. 1A, 1B, 2A, 2B, 3, 4A and 4B. As shown, the article of apparel 10 in accordance with the invention includes an outer shell 105 and an integral support structure 110 disposed within the shell. As seen best in FIGS. 1A and 1B, the shell 105 is a garment such as a tank top including a body 115 and shoulder straps 120A, 120B. The body 115, which covers the torso of the wearer, includes a forward portion 125A (covering the front of the torso) and a rearward portion 125B (covering the back of the torso). The upper edge of the front portion 125A defines a central neckline 127 and an arm line 130A, 130B disposed on each side of the neckline. Similarly, the upper edge of the rear portion 125B includes a backlines 132A, 132B disposed on opposite sides of a central scoop 135.

Each shoulder strap 120A, 120B originates along a respective arm line 130A, 130B, of the forward portion 125A, extending rearward to connect to the backline 132A, 132B proximate the scoop 135. The straps 120A, 120B may be adjustable, permitting the vertical repositioning of the body 115 relative to the torso.

The integrated support structure 110 is disposed on the interior (skin-facing) side of the shell 105. In an embodiment, the support structure 110 is suspended from the outer shell 105. Specifically, the upper edge of the support structure 110 is secured continuously (e.g., via stitching) to the neckline 127, arm lines 130A, 130B, backlines 132A, 132B and scoop 135 of the garment body 115, leaving the lower edge of the structure unsecured. With this configuration, the support structure 110 may pivot relative to the outer shell 105, permitting easy access to the support structure (i.e., a user may fold the support structure 110 from an interior position, in which the structure is housed within the shell 105, to an exterior position, in which the structure extends outward from the shell).

Figure 2B:
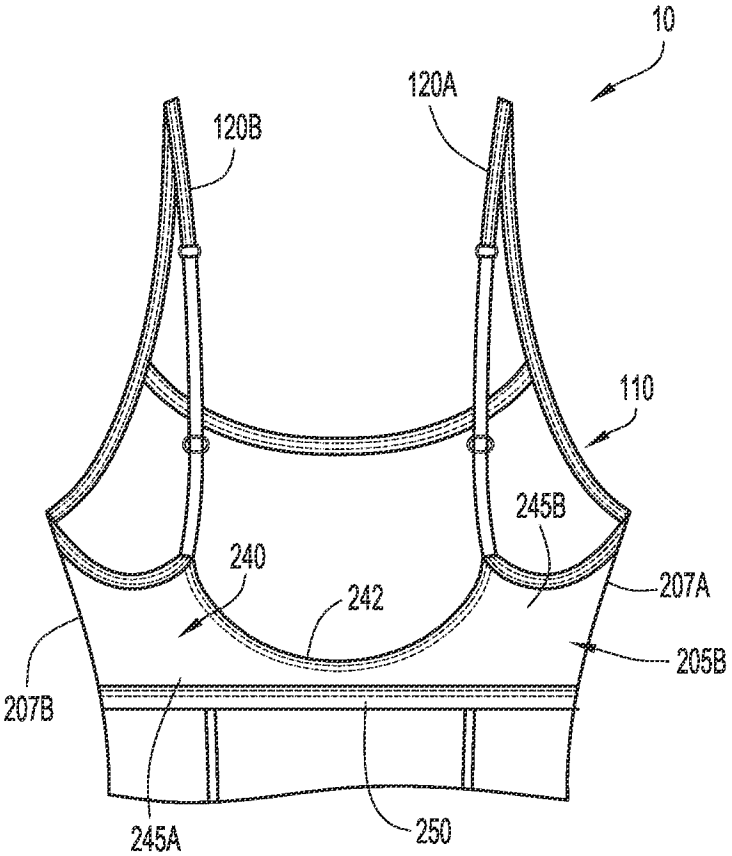
FIG. 2B is article of apparel of FIG. 1B, with the outer shell removed for clarity, thereby showing a rear view of the integrated support structure.
Figure 2A:
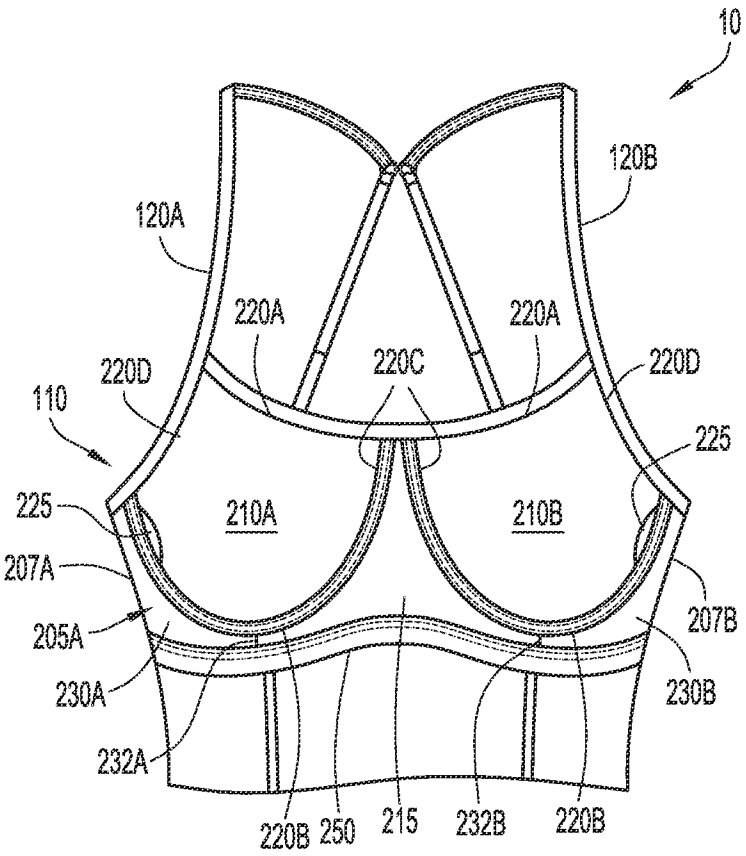
FIG. 2A is article of apparel of FIG. 1A, with the outer shell removed for clarity, thereby showing a front view of the integrated support structure.
Figure 3:
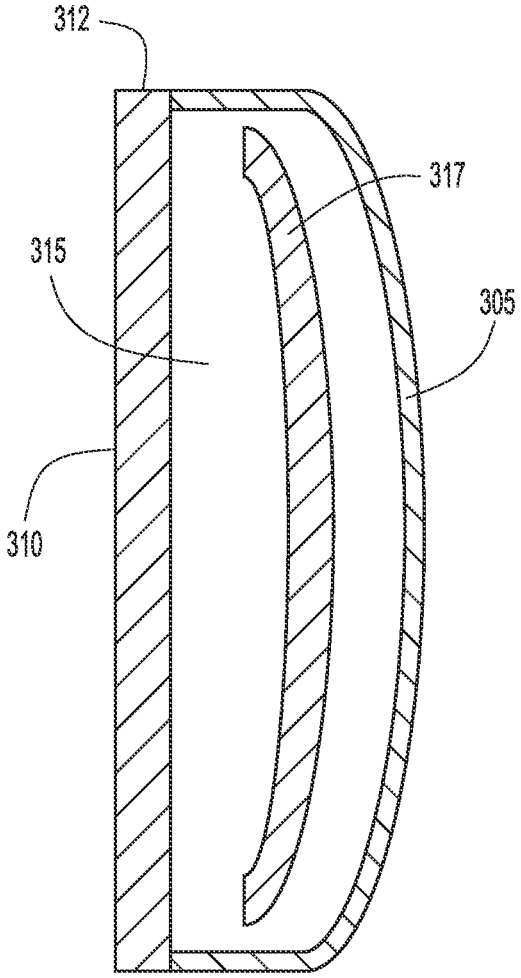
FIG. 3 is a cross sectional view of a cup structure in accordance with an embodiment of the invention.
Figure 4B:
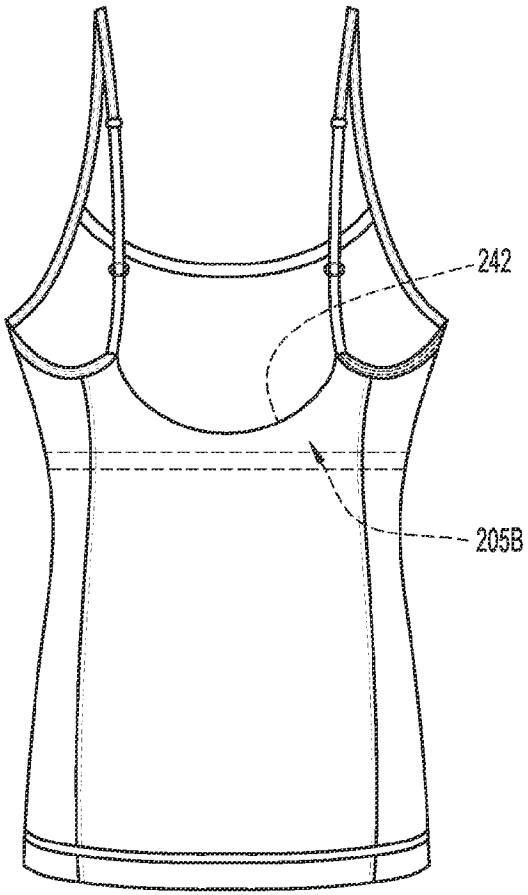
FIGS. 4A and 4B are front and rear views, respectively, of the garment of FIGS. 1A and 1B including the support structure of FIGS. 2A and 2B.
Figure 4A:
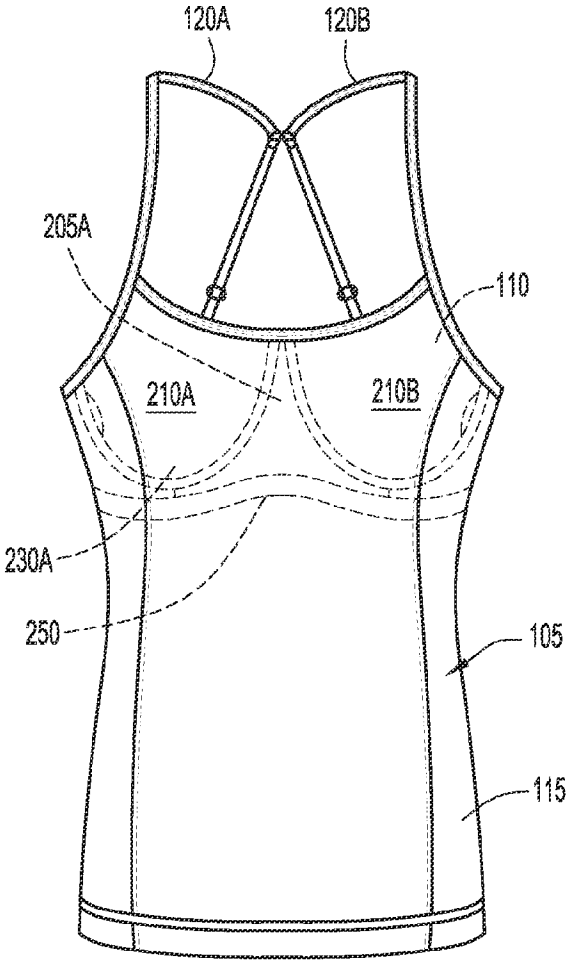

As seen best in FIGS. 2A and 2B, the support structure 110 is the form of a brassiere (bra) having a forward or chest portion 205B and a rearward or back portion 205B. The forward bra portion 205A generally spans the forward portion 125A of the shell body 115 (and thus the front and sides of the torso). Similarly, rearward portion 205B generally spans the rearward portion 125B of the shell body 115 (and thus the back of the torso). The forward portion 205A may be secured to the rearward portion 205B, e.g., via a side seam 207A, 207B. The support structure (e.g., its upper edge) is generally contoured to register with the contour of the upper edge of the body 115.

The forward portion 205A of the support 110 includes a first cup 210A laterally spaced from a second cup 210B by a bridging member 215. As seen best in FIG. 3, each cup 210A, 210B includes a first/outer (shell-facing) wall 305 and a second/inner (user-facing) wall 310. The outer wall may be molded such that it possesses a generally concave shape. The walls 305, 310 of the cup 210A, 210B are secured about their periphery (e.g., via stitching 312) to define an upper edge 220A, a lower edge 220B, a medial edge 220C, and a lateral edge 220D. With this configuration, each cup 210A, 210B forms an interior chamber or pocket 315 operable to receive an insert 317 such as a support pad (discussed in greater detail below). The inner wall 310 includes a notched out area 225 not secured to the forward wall 305, thereby forming an opening through which the insert may be placed into and removed from the pocket.

The outer 305 and inner 310 walls of the cup 210A and 210B may be formed from any material suitable for their described purpose. The cup walls 305, 310, moreover, may be formed of the same or of different materials. In an embodiment, the outer wall 305 of the cup 210A, 210B is formed of a textile (e.g., knit or woven fabric) having a first degree of breathability and resiliency, while the inner wall 310 of the cup 210A, 210B is formed of a textile having a second degree of breathability or resiliency. By way of example, the textile forming the outer wall 305 textile possesses a higher degree of breathability than the textile forming the inner wall 310. The textile forming the outer wall 305, furthermore, may possess a lower degree of resiliency than the textile forming the inner wall 310. By way of specific example, the outer wall 305 may be formed of a single layer powermesh. The outer wall material may be molded to provide the outer wall 305 with a generally concave shape. The inner wall, moreover, may be formed of a self fabric.

The bridging member 215 separates the first cup 210A from the second cup 210B. Specifically, the bridging member 215 extends distally from the neckline 130 of the shell body, extending along the medial edge 220C of each cup 210A, 210B and partially around cup lower edge 220B. The bridging member 215 is formed from a textile (e.g., knit or woven fabric) possessing little or no resiliency/stretch. By way example, the bridging member may be a non-stretch tricot. Optionally, the bridging member 115 may further include a secondary textile along its inner (user-facing) surface such as a power mesh material. With this configuration, the cups 210A, 210B are secured in position. That is, the relative position of the first cup 210A is maintained relative to the second cup 210B, thereby forming a cradle system that provides separation and support.

The forward portion 205A of the support 110 further includes a first lateral member or side panel 230A secured to the bridging member along first seam 232A (disposed at an intermediate location along the bottom edge 220B of the first cup 210A) and a second lateral member or side panel 230B secured to the bridging member 215 along second seam 232B (disposed at an intermediate location along the lower edge 220B of second cup 210B). Each lateral member 230A, 230B is formed of a resilient textile (e.g., a knitted or woven fabric) to allow expansion lateral expansion of the forward portion 205A. In an embodiment, the side panels 230A, 230 possess a resiliency that differs from the resiliency of each of the bridging member 215 and the material forming the back panel (discussed in greater detail below). By way of specific example, the side panels 230A, 230B may be formed of a double layer powermesh.

The rearward portion 205B of the support 110 generally spans the back of wearer, extending from the first side panel 230A (connected thereto via side seam 207A) to the second side panel 230B (connected thereto via side seam 207B). In an embodiment, the rearward portion 205B is in the form of a back panel 240 with a central scoop 242 that permits the relative movement of one section 245A of the band relative to another section 245B. The back panel 240 may be formed of a resilient textile (e.g., a woven or knitted fabric) effective to expand a predetermined distance when a force is applied, and then retract back once the force is removed. In a specific embodiment, the band is single layer powermesh.

The support structure 110 further includes a resilient band 250 secured to its front 205A and rear 205B portions utilizing conventional means (e.g., stitching). Specifically, the resilient band is secured to the lower edge of the bridge member 215 and side panels 230A, 230B along the forward portion 205A, as well as to the lower edge of the band 240 forming the rearward portion 205B. With this configuration, the resilient band 250 surrounds the torso, helping to secure the support structure 110 to the wearer.

As noted above, each cup 210A, 210B receives an insert 317 operable to provide shape and support thereto. The insert 317 may be formed of any material suitable for its described purpose. In an embodiment, the insert includes a foam layer (e.g., open-cell foam). By way of example, the insert is formed via compression molding. Compression molding is a method of molding in which the molding material is first placed in an open, heated mold cavity. The mold is closed with a top force or plug member, pressure is applied to force the material into contact with all mold areas, while heat and pressure are maintained until the molding material has cured. Specifically, the compression molding apparatus includes a first or female molding portion configured to receive a second or male molding portion possessing a shape complementary to the shape of the first molding portion. The apparatus may be utilized to shape a single layer, or may be utilized to shape a multilayered structure. Upon compression (and the application of heat), the layers adhere, forming a laminate having a three dimensional shape. Specifically, the insert possesses a generally concave shape (e.g., it may be contoured to register with the shape of the outer wall 305).

With the above configuration, an article of apparel having varying degrees of resiliency is provided. The cup pockets, moreover, have an outer wall 305 that is molded to possess a similar degree of curvature to that of the curved insert 317. These features combine to provide improved support over conventional garments. In particular, the configuration of the invention provides lift and separation, as well as provides shape to the breasts. Additionally, the selective removal of the inserts is permitted via the cup pockets.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

We claim:

1. An article of apparel to be worn by a wearer, the article comprising:

an outer garment including:

an outer body to cover a torso of the wearer, the outer body defining an interior chamber, and one or more straps to secure the garment to the wearer; and a support structure disposed within the interior chamber of the garment, the support structure including:

a forward portion to span a front of the torso, the forward portion comprising:

a first cup laterally spaced from a second cup, wherein each of the first cup and second cup includes:

an outer wall having a first degree of breathability, and an inner wall having a second degree of breathability, a bridge member disposed between the first cup and the second cup; and a rearward portion to span a back of the torso, wherein the bridge member comprises material having a first degree of resiliency and the rearward portion comprises material having a second degree of resiliency.

2. The article of claim 1, wherein the material forming the bridge member is a non-stretch textile.

3. The article of claim 2, wherein the non-stretch textile is tricot.

4. The article of claim 1, wherein:

each of the outer wall and the inner wall define a peripheral edge; and the peripheral edges of the inner and outer walls are secured such that the walls cooperate to define an interior pocket.

5. The article of claim 1, wherein:

the rear wall is notched;

the front and rear walls are secured along the peripheral edges except in the area of the notch;

the notch defines an opening to permit insertion and removal of an insert from the interior cup chamber.

6. The article of claim 5, wherein the insert comprises foam, the insert being compression molded to possess a generally concave shape.

7. The article of claim 6, wherein the insert comprises a foam laminate including a textile layer.

8. The article of claim 5, wherein the outer wall of each cup is formed of a power mesh material.

9. The article of claim 8, wherein the power mesh material is molded to possess a generally concave shape.

10. The article of claim 1, further including a resilient member disposed along a lower edge of the support structure, the resilient member configured to surround the torso of the wearer.

11. The article of claim 1, wherein the forward portion further includes a lateral member extending from the bridge member to the rearward portion, the lateral member possessing a third degree of resiliency different from at least one of the first degree of resiliency and the second degree of resiliency.

12. The article of claim 1, wherein:

the outer wall possesses a first degree of resiliency; and the inner wall possesses a second degree of resiliency.

* * * * *